US010435116B2

(12) United States Patent
Van Den Ende

(10) Patent No.: US 10,435,116 B2
(45) Date of Patent: Oct. 8, 2019

(54) ANCHOR WITH ANGLE ADJUSTMENT PROVISION

(71) Applicant: Stevlos B.V., Capelle Aan Den Ijssel (NL)

(72) Inventor: David Peter Van Den Ende, Zuid-Beijerland (NL)

(73) Assignee: STEVLOS B.V. (NL)

( * ) Notice: Subject to any disclaimer, the term of this patent is extended or adjusted under 35 U.S.C. 154(b) by 0 days.

(21) Appl. No.: 15/772,002

(22) PCT Filed: Sep. 30, 2016

(86) PCT No.: PCT/NL2016/050671
§ 371 (c)(1),
(2) Date: Apr. 27, 2018

(87) PCT Pub. No.: WO2017/074178
PCT Pub. Date: May 4, 2017

(65) Prior Publication Data

US 2018/0222554 A1 Aug. 9, 2018

(30) Foreign Application Priority Data

Oct. 27, 2015 (NL) ..... 2015666

(51) Int. Cl.
*B63B 21/32* (2006.01)
*B63B 21/34* (2006.01)
(Continued)

(52) U.S. Cl.
CPC ..... *B63B 21/32* (2013.01); *B63B 21/26* (2013.01); *B63B 21/34* (2013.01); *B63B 21/50* (2013.01); *B63B 2021/262* (2013.01)

(58) Field of Classification Search
CPC ..... B63B 21/32; B63B 21/26; B63B 21/34; B63B 21/50; B63B 2021/262
See application file for complete search history.

(56) References Cited

U.S. PATENT DOCUMENTS 5,540,175 A * 7/1996 Van Den Haak ..... B63B 21/22 114/293

FOREIGN PATENT DOCUMENTS

GB 2183580 6/1987 ..... B63B 21/30
GB 2522196 7/2015 ..... B63B 21/38
(Continued)

OTHER PUBLICATIONS

International Preliminary Report on Patentability issued in application No. PCT/NL2016/050671, dated May 1, 2018 (6 pgs).
(Continued)

*Primary Examiner* — Stephen P Avila
(74) *Attorney, Agent, or Firm* — Hayes Soloway P.C.

(57) ABSTRACT

An anchor has a fluke, a shank that is connected to the fluke, a coupling to attach the fluke to an anchor line or anchor chain, and an angle adjustment provision to adjust the angle between the shank and the fluke, wherein the angle adjustment provision is a hinge between the fluke and the shank, a first positioning member connected to the shank that is provided with a series of first positioning holes at a first intermediate distance and a second positioning member connected to the fluke that is provided with a series of second positioning holes at a second intermediate distance and spaced apart from the hinge axis, and a positioning pin that is inserted in one of the aligned first and second positioning holes, wherein the second intermediate distance differs from the first intermediate distance.

16 Claims, 3 Drawing Sheets

(51) Int. Cl.
*B63B 21/26* (2006.01)
*B63B 21/50* (2006.01)

(56) References Cited

FOREIGN PATENT DOCUMENTS

| | | | | |
|---|---|---|---|---|
| WO | WO0181161 | 11/2001 | ..... | B63B 21/24 |
| WO | WO2011128689 | 10/2011 | ..... | B63B 21/42 |

OTHER PUBLICATIONS

International Search Report and Written Opinion issued in application No. PCT/NL2016/050671, dated Nov. 21, 2016 (10 pgs).

* cited by examiner

ANCHOR WITH ANGLE ADJUSTMENT PROVISION

BACKGROUND

The invention relates to an anchor comprising a fluke, a shank that is connected to the fluke, a coupling to attach the shank to an anchor line or anchor chain, and an angle adjustment provision to adjust the angle between the shank and the fluke.

These type of anchors are used for heavy maritime or offshore objects, such as a drilling platform. The angle between the shank and the fluke is set to optimize the anchor for the type of anchoring soil, such as clay, sand or rocks. During penetration and use high forces act on the anchor, which are transferred from the shank to the fluke via the angle adjustment provision. There is a need for an anchor adjustment that can both transfer high forces and that can be set in various angles that are close to each other. Up to now these contrary requirements have not been implemented satisfactory.

It is an object of the present invention to provide an anchor with an angle adjustment provision between the shank and the fluke, that can transfer high forces and that can be set in various angles that are close to each other.

SUMMARY OF THE INVENTION

The invention provides an anchor comprising a fluke, a shank that is connected to the fluke, a coupling to attach the shank to an anchor line or anchor chain, and an angle adjustment provision to adjust the angle between the shank and the fluke, wherein the angle adjustment provision comprises a hinge between the fluke and the shank to pivot the shank with respect to the fluke in the plane of symmetry of the anchor around a hinge axis, a first positioning member connected to the shank that is provided with a series of first positioning holes at a first intermediate distance and spaced apart from the hinge axis, a second positioning member connected to the fluke that is provided with a series of second positioning holes at a second intermediate distance and spaced apart from the hinge axis, and a positioning pin that is inserted in one of the aligned first and second positioning holes, wherein the second intermediate distance differs from the first intermediate distance.

The anchor according to the invention comprises an angle adjustment provision between the shank and the fluke in which the angle is set by choosing a combination of a first positioning hole and a second positioning hole to be aligned. As the second intermediate distance differs from the first intermediate distance, a fine adjustment can be set by toggling the positioning pin between adjacent positioning holes without impairing the strength of the construction.

In an embodiment the second intermediate distance is smaller than the first intermediate distance, whereby the fine adjustment is implemented by toggling between the second positioning holes that are close to or even inside the fluke.

In an embodiment the second intermediate distance is 40-80% of the first intermediate distance.

In an embodiment the shank comprises two shank legs that are symmetrically positioned on opposite sides of the plane of symmetry of the anchor and that diverge from the coupling towards the fluke, wherein the angle adjustment provision comprises two first positioning members on the shank legs and two second positioning members on the fluke cooperating therewith.

In an embodiment thereof the shank legs have a base section at the fluke, wherein the fluke comprises two penetration plates extending obliquely downwards with respect to the base section of the shank legs, and two first girders below and connected to the penetration plates, wherein the first positioning members form part of the base sections and the second positioning members form part of the first girders. In this embodiment the angle adjustment provision is implemented in the parts of the anchor itself.

In an embodiment thereof the fluke comprises second girders aside the first girders, wherein the second girders comprise a third positioning member that is provided with a series of third positioning holes that are aligned with the second positioning holes, wherein the first positioning members are inserted between the second positioning members and third positioning members. The insertion of the first positioning member between the second positioning members and third positioning members prevents adverse bending moments onto the positioning pin.

In an embodiment the base sections and the girders are plate shaped, having their main planes parallel to the plane of symmetry of the anchor.

In an embodiment is at least one of the second positioning holes at least partly positioned below the main plane of the fluke plates, wherein the fluke plates are provided with an aperture to allow passage of the positioning pin, which aperture is covered with a shutter that is hingeably connected to the fluke plate, wherein the shutter is hingeable between an open position, in which the positioning pin can be inserted in the second positioning hole, and a closed position, in which it covers the aperture. In this embodiment the positioning pin can be positioned below the top surface of the fluke, whereby it is prevented that the positioning pin impairs the penetrating properties of the fluke.

In an embodiment thereof the shutter locks the inserted positioning pin in its closed position.

The invention further relates to a computer-readable medium having computer-executable instructions adapted to cause a 3D printer to print an anchor according to any one of the preceding claims.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached drawings, in which.

DETAILED DESCRIPTION OF THE INVENTION

Figure 1:
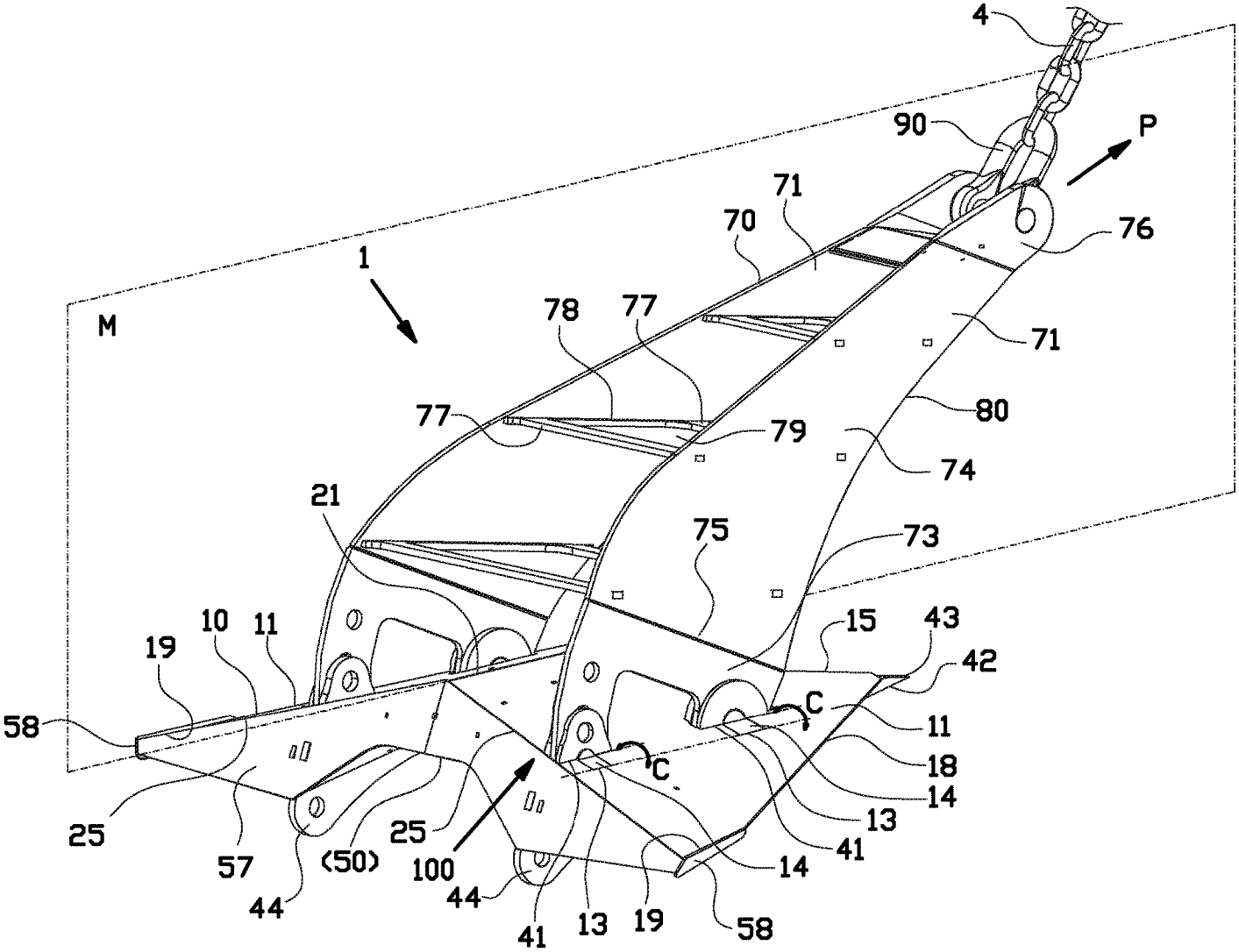
FIG. 1 is an isometric side view of an anchor with an angle adjustment provision according to the invention.

FIG. 1 shows an anchor 1 according to an embodiment of the invention. The anchor 1 is intended for anchoring heavy maritime or offshore objects, such as a drilling platform in a subsea anchoring ground, for a long period of use that may last many years. The anchor 1 has a typical deadweight of 1-50 tons.

The anchor 1 comprises a fluke 10 and a shank 70 which with respect to the fluke 10 inclines obliquely forward and which at its end is provided with a shackle 90 by which the anchor 1 is connected to an anchor line or anchor chain 4. The anchor 1 is substantially symmetrical with respect to its plane of symmetry M. The anchor 1 is formed for in a forward penetration direction P being introduced into the anchoring ground substantially parallel to the plane of symmetry M.

The fluke 10 is a hollow box built up using steel plate members that are connected to each other by welding. As best shown in FIG. 1 the fluke 10 comprises two straight penetration plates 11 that are oriented obliquely with respect to the plane of symmetry M. The penetration plates 11 each have a straight inner penetration edge 15 and a longer straight outer penetration edge 18 that are directed towards each other in the penetration direction P. The straight inner penetration edge 15 and the straight outer penetration edge 18 extend are under the same angle with respect to the plane of symmetry M. The outer penetration edges 18 merge into a shorter outer fluke edge 19 that extends under a smaller angle with respect to the plane of symmetry M. The penetration plates 11 comprise straight upper fluke edges 21 that are welded together in the plane of symmetry M. The penetration plates 11 each comprise a straight rear fluke edge 25 extending between the upper fluke edges 21 and the outer fluke edges 19. The rear fluke edges 25 are oriented oblique to the plane of symmetry M, having their merging ends located forwards in the penetration direction P.

Figure 2:
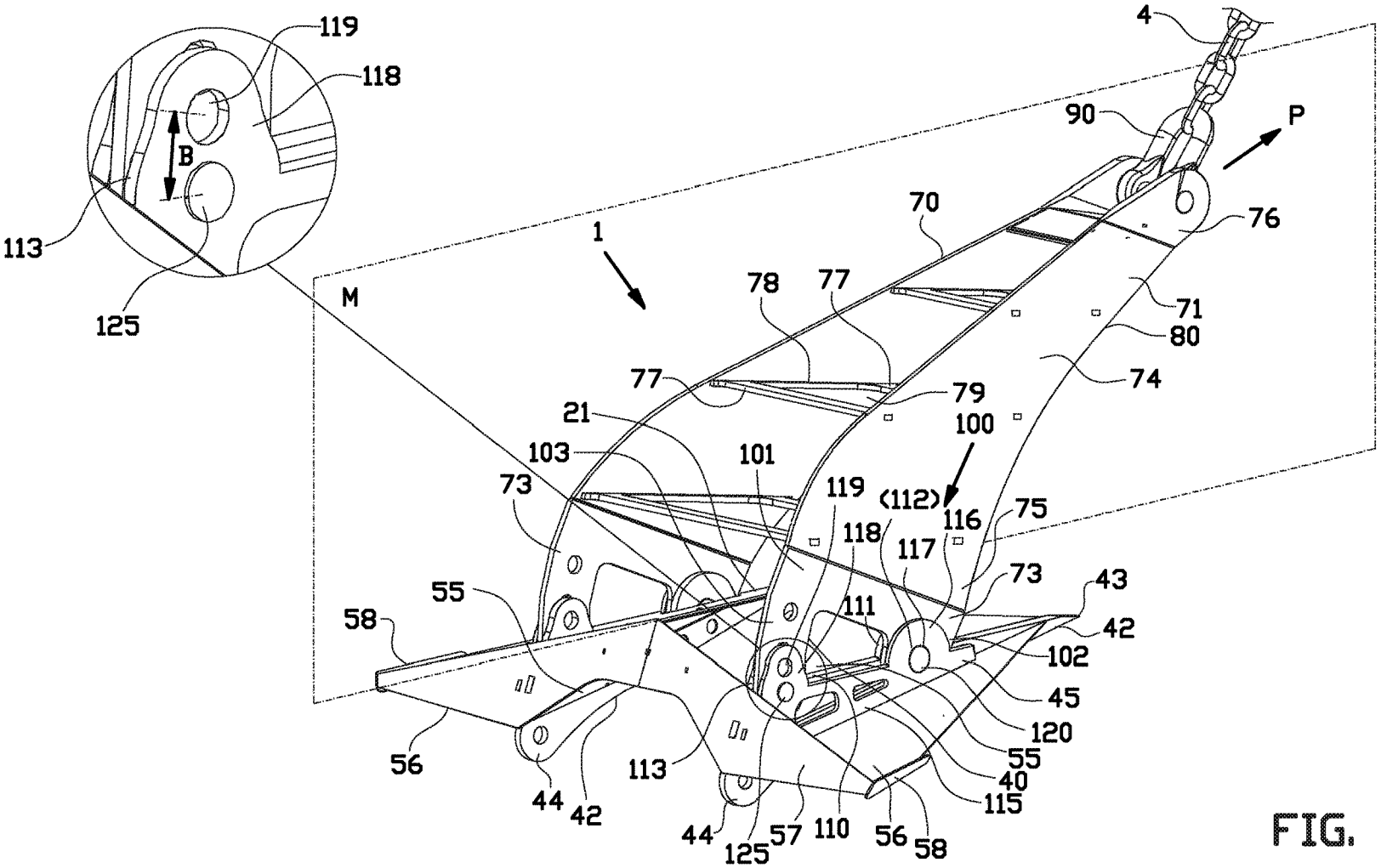
FIGS. 2 and 3 are the anchor according to FIG. 1, wherein successively parts have been taken away to show the internal parts of the angle adjustment.

As best shown in FIG. 2 the fluke 10 comprises two first girder plates 40 extending parallel to the plane of symmetry M. The first girder plates 40 have a straight lower edge 42 extending freely at the bottom side of the fluke 10. At the front side the lower edge 42 merges into a penetration tip 43 that may be of a hardened steel. At the rear side the lower edge 42 merges into a hoisting eye 44. The fluke 10 comprises two second girder plates 45 extending parallel to and spaced apart from the first girder plates 40 at the outer sides thereof. The second girder plates 45 have their bottom edges inside the fluke 10.

Figure 3:
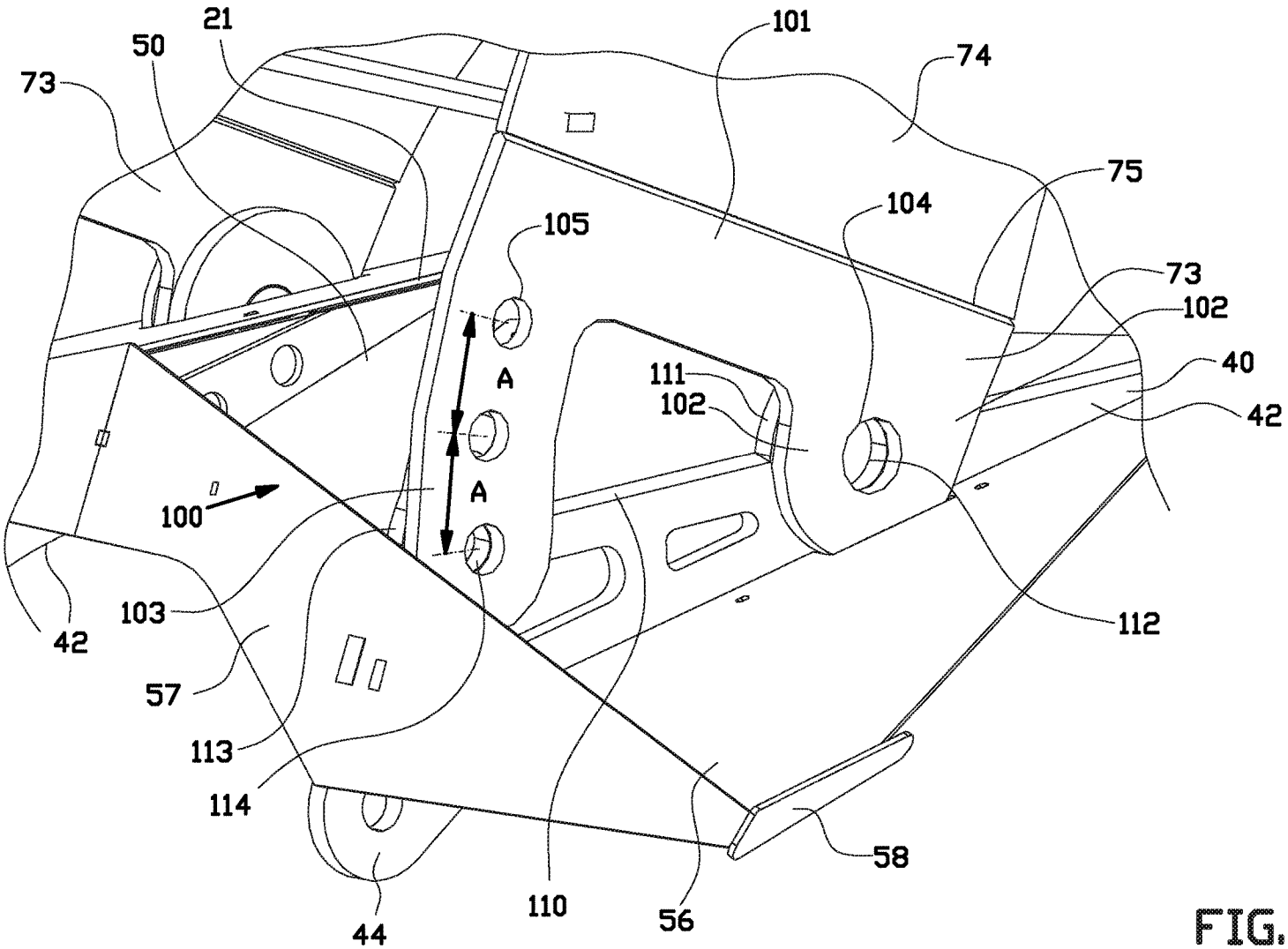

As best shown in FIGS. 1 and 3, the fluke 10 comprises a central stiffening plate 50 extending perpendicular to the plane of symmetry M. The central stiffening plate 50 extends below the penetration plates 11 and are spaced apart therefrom except for its front edge 51 were it is welded thereto.

As best shown in FIGS. 2 and 3, the fluke 10 comprises two straight inner stiffening plates 55 between the central stiffening plate 50 and the first girder plates 40. The inner stiffening plates 55 are welded to the side edges of the central stiffening plate 55 and are welded to the penetration plates 11, 12 along the straight inner penetration edges 15 thereof. The inner stiffening plates 55 are welded to the first girder plates 40 in a recessed position and parallel to the straight lower edge 42 of the first girder plates 40.

As best shown in FIGS. 2 and 3, the fluke 10 comprises two straight outer stiffening plates 56 extending upwards from the first girder plates 40 towards the penetration plates 11. The outer stiffening plates 56 are welded to the penetration plates 11 along the straight outer penetration edges 18 thereof. The outer stiffening plates 56 are welded to the first girder plates 40 in a recessed position and parallel to the straight lower edge 42 of the first girder plates 40.

The fluke 10 comprises a straight rear stiffening plate 57 having an outer contour that follows the rear edges of the penetration plates 11, the central stiffening plate 50, the inner stiffening plates 55 and the outer stiffening plates 56. The rear stiffening plate 57 is welded thereto along its edges. In its upward direction the rear stiffening plate 57 is oriented obliquely forwards with respect to the straight upper fluke edges 21 that are welded together. The fluke 10 comprises two straight stabiliser plates 58 that close off the hollow fluke 10 along the outer fluke edges 19 of the penetration plates 11.

The shank 70 is built up using steel plate members that are connected to each other by welding. The shank 70 comprises two shank legs 71 that are symmetric with respect to the longitudinal plane of symmetry M. The shank legs 71 diverge towards the fluke 10. The shank legs 71 each comprise a straight base section 73 that is connected to the first girder plates 40 by means of an angle adjustment provision 100 that is described in more detail later on. The shank legs 71 comprise a straight middle section 74 that is oriented under an angle with respect to the base section 72 via a deflection line 75. The middle section 74 has a tapering and curved outline. In particular it has a concave curved front edge 80 between the fluke 10 and the shackle 90, having its smallest radius at the side of the fluke 70. The shank legs 71 each comprise and an end eye 76 with a hole to couple with the shackle 90. The middle sections 74 are rigidly connected to each other with multiple parallel rods 77. Pairs of the parallel rods 77 form part of a framework 78 with a central hole 79. The parallel rods 77 can thereby be welded to the middle sections 74 in pairs by welding one framework 78. In a projection perpendicular to the straight upper fluke edges 21 that are welded together in the plane of symmetry M, the end eye 76 for the shackle 90 extends beyond the penetration tips 43 in the penetration direction P.

The angle adjustment provision 100 is formed with parts of the base section 73 and with parts of the first girder plates 40 and second girder plates 45. The main plane of the base section 73 extends parallel to the main plane of the first girder plates 40 and second girder plates 45. As shown in FIG. 3, the base section 73 comprises a base strip 101, and a first lug 102 with a first hinge hole 104 and a curved first positioning member 103 with multiple first positioning holes 105 projecting towards the fluke 10. The first girder plates 40 comprise a wedge shaped first base body 110 inside the fluke 10, and a second lug 111 with a second hinge hole 112 and a second positioning member 113 with two second positioning holes 114 projecting upwards to the shank 70. As shown in FIG. 2, the second girder plates 45 comprise a wedge shaped second base body 115 inside the fluke 10, and a third lug 116 with a third hinge hole 117 and a third positioning member 118 with two third positioning holes 119 projecting upwards to the shank 70. The two third positioning holes 119 are aligned with the two second positioning holes 114. As shown in FIG. 1, the second lugs 111, the third lugs 116, the second positioning members 113 and the third positioning members 118 all pass through slots 41 in the penetration plates 11.

As shown in FIG. 2, the angle adjustment provision 100 furthermore comprises on each side of the plane of symmetry M a hinge pin 120 through the aligned hinge holes 104, 112, 117 and an adjustment pin 125 passing to one of the aligned positioning holes 104, 114, 119. As best shown in FIG. 3, the first positioning holes 105 are located at the same distance with respect to the first hinge holes 104, having the same first intermediate distances A between the first positioning holes 105. As best shown in FIG. 2, the second positioning holes 114 and the third positioning holes 119 are located at the same distance with respect to the first hinge holes 104 as the first positioning holes 105, having a second intermediate distance B between the second positioning holes 114 and the third positioning holes 119. The second intermediate distance B is different, in particular smaller than the first intermediate distance A. In this manner the angle adjustment provision 100 allows the angle between the shank 70 and the fluke 10 to be set in multiple preset angles, wherein the rough angle adjustment is done by selecting one of the first positioning holes 105 and the fine adjustment is done by selecting one or toggling between the aligned second positioning holes 114 and the third positioning holes 119.

As best shown in FIG. 1 the adjustment pins 125 are firstly inserted in the third positioning holes 119 from outside the shank 70, wherein the lowest third positioning holes 119 are located partly below the top surface of the penetration plates 11. The same applies for the hinge pins 120. Therefore the penetration plates 11 are provided with rectangular apertures 13 adjacent to this third positioning holes 119 and third hinge holes 117. These apertures are closed off with steel plated shutters 14 that are hingeable around a hinge axis C at the opposite edge with respect to the third positioning holes 119 and third hinge holes 117. In the open position the shutters 14 allow insertion of the pins 120, 125 from outside towards the plane of symmetry M. In the closed position the shutters 14 are flush with the top surface of the penetration plates 11 or fall down slightly deeper, about parallel to the axis of the pins 120, 125 to securely lock their inserted position.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

The invention claimed is:

1. An anchor comprising a fluke, a shank that is connected to the fluke, a coupling to attach the shank to an anchor line or anchor chain, and an angle adjustment provision to adjust the angle between the shank and the fluke, wherein the angle adjustment provision comprises a hinge between the fluke and the shank to pivot the shank with respect to the fluke in the plane of symmetry of the anchor around a hinge axis, a first positioning member connected to the shank that is provided with a series of first positioning holes at a first intermediate distance and spaced apart from the hinge axis, a second positioning member connected to the fluke that is provided with a series of second positioning holes at a second intermediate distance and spaced apart from the hinge axis, and a positioning pin that is inserted in one of the aligned first and second positioning holes, wherein the second intermediate distance differs from the first intermediate distance.

2. The anchor according to claim 1, wherein the second intermediate distance is smaller than the first intermediate distance.

3. The anchor according to claim 1, wherein the second intermediate distance is 40-80% of the first intermediate distance.

4. The anchor according to claim 1, wherein the shank comprises two shank legs that are symmetrically positioned on opposite sides of the plane of symmetry of the anchor and that diverge from the coupling towards the fluke, wherein the angle adjustment provision comprises two first positioning members on the shank legs and two second positioning members on the fluke cooperating therewith.

5. The anchor according to claim 4, wherein the shank legs have a base section at the fluke, wherein the fluke comprises two penetration plates extending obliquely downwards with respect to the base section of the shank legs, and two first girders below and connected to the penetration plates, wherein the first positioning members form part of the base sections and the second positioning members for in part of the first girders.

6. The anchor according to claim 5, wherein the fluke comprises second girders aside the first girders, wherein the second girders comprise a third positioning member that is provided with a series of third positioning holes that are aligned with the second positioning holes, wherein the first positioning members are inserted between the second positioning members and third positioning members.

7. The anchor according to claim 5, wherein the base sections and the girders are plate shaped, having their main planes parallel to the plane of symmetry of the anchor.

8. The anchor according to claim 4, wherein at least one of the second positioning holes is positioned at least partly below the main plane of the penetration plates, wherein the penetration plates are provided with an aperture to allow passage of the positioning pin, which aperture is covered with a shutter that is hingeably connected to the penetration plate, wherein the shutter is hingeable between an open position, in which the positioning pin can be inserted in the second positioning hole, and a closed position, in which it covers the aperture.

9. The anchor according to claim 8, wherein the shutter locks the inserted positioning pin in its closed position.

10. A computer-readable medium having computer-executable instructions adapted to cause a 3D printer to print an anchor according to claim 1.

11. The anchor according to claim 6, wherein the base sections and the girders are plate shaped, having their main planes parallel to the plane of symmetry of the anchor.

12. The anchor according to claim 2, wherein the second intermediate distance is 40-80% of the first intermediate distance.

13. The anchor according to claim 6, wherein the base sections and the girders are plate shaped, having their main planes parallel to the plane of symmetry of the anchor.

14. The anchor according to claim 5, wherein at least one of the second positioning holes is positioned at least partly below the main plane of the penetration plates, wherein the penetration plates are provided with an aperture to allow passage of the positioning pin, which aperture is covered with a shutter that is hingeably connected to the penetration plate, wherein the shutter is hingeable between an open position, in which the positioning pin can be inserted in the second positioning hole, and a closed position, in which it covers the aperture.

15. The anchor according to claim 6, wherein at least one of the second positioning holes is positioned at least partly below the main plane of the penetration plates, wherein the penetration plates are provided with an aperture to allow passage of the positioning pin, which aperture is covered with a shutter that is hingeably connected to the penetration plate, wherein the shutter is hingeable between an open position, in which the positioning pin can be inserted in the second positioning hole, and a closed position, in which it covers the aperture.

16. The anchor according to claim 7, wherein at least one of the second positioning holes is positioned at least partly below the main plane of the penetration plates, wherein the penetration plates are provided with an aperture to allow passage of the positioning pin, which aperture is covered with a shutter that is hingeably connected to the penetration plate, wherein the shutter is hingeable between an open position, in which the positioning pin can be inserted in the second positioning hole, and a closed position, in which it covers the aperture.

* * * * *